United States Patent [19]

Takiguchi

[11] 4,079,227

[45] Mar. 14, 1978

[54] CONTACT HEAT FIXING APPARATUS FOR ELECTROPHOTOGRAPHIC REPRODUCTION MACHINES

[75] Inventor: Koichi Takiguchi, Ebina, Japan

[73] Assignee: Rank Xerox Ltd., London, England

[21] Appl. No.: 724,783

[22] Filed: Sep. 20, 1976

[30] Foreign Application Priority Data

Sep. 25, 1975 Japan ..... 50-114856

[51] Int. Cl.[2] ..... H05B 1/00; G03G 15/20

[52] U.S. Cl. ..... 219/216; 219/388; 219/470; 432/60

[58] Field of Search ..... 219/216, 388, 469–471; 355/3 FU, 76; 432/60, 228; 118/60

[56] References Cited

U.S. PATENT DOCUMENTS

| | | | |
|---|---|---|---|
| 3,811,821 | 5/1974 | Ariyama et al. | 219/216 |
| 3,874,843 | 4/1975 | Fujimoto | 219/216 X |
| 3,945,726 | 3/1976 | Ito | 219/216 X |

*Primary Examiner*—C. L. Albriton

[57] ABSTRACT

A contact heat fixing apparatus for electrophotographic reproduction machines wherein a heating roll 1 and a pressure roll 2 contact each other while rotating under pressure and an auxiliary heating roll 12 is provided which is engageable with and disengageable from the heating roll 1 and said auxiliary heating roll 12 is heated by means of a heating device 13 to a predetermined temperature and said auxiliary heating roll 12 is contacted under pressure to the heating roll 1 to heat the same when the temperature on the surface of said heating roll 1 falls below a temperature capable of fixing toner.

5 Claims, 3 Drawing Figures

CONTACT HEAT FIXING APPARATUS FOR ELECTROPHOTOGRAPHIC REPRODUCTION MACHINES

BACKGROUND OF THE INVENTION

This invention relates, in general to electrophotographic apparatus and more particularly, to contact fixing apparatus therefor.

Figure 1:
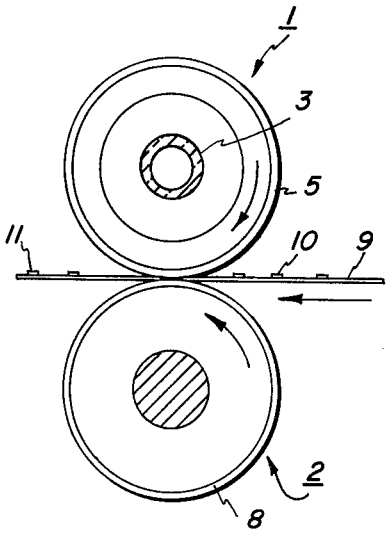

In electrophotographic reproduction machines, contact heat fixing apparatuses using heating rolls have often been employed as fixing means. The contact heat fixing apparatus of this type comprise, as shown in FIG. 1, a pair of rolls 1 and 2 provided on the surfaces thereof with covers 5 and 8 of non-adhesive material, for example, tetrafluoroethylene resin or silicone rubber, fluorocarbon resin or the like. Either one or both of the rolls 1 and 2 may be axially provided with a heating device 3 such as tubular infrared lamps or the like. The rolls 1 and 2 are rotatably supported for contact with each other and an appropriate pressure is applied therebetween to form a nip through which a support 9 having non-fixed thermoplastic powder 10 (referred to as toner hereinafter) deposited thereon is passed for fixing the non-fixed toner to the support. The contact heat fixing apparatus described above is advantageous in that it can be used with less electric power than fixing apparatus utilizing irradiated heat as well as without dangers of fire hazard and burning.

In conventional reproduction machines, most of the electric power used in the entire machine is consumed by the fixing apparatus and when the total electric power consumed by the machine is determined the number of sheets of copy paper obtainable per unit time are automatically set from the electric power required for the continuous reproduction, even if the above contact heat fixing apparatus requiring relatively less electric power is used.

Reproduction machines which can be used with receptacles or power outlets rated at 100V and 15A are highly desirable where the electric power available for the fixing system is between 700–100W after taking into consideration the electric power required for the driving system, optical system, developing system or the like from the totally available power of 1.5 KVA. At present most of the reproduction machines generally provide 1000 to 2000 sheets of copy paper per hour when using a contact heat fixing apparatus, depending upon the heat efficiency of the fixing apparatus. It has been difficult to provide a reproduction machine capable of satisfying the requirements such as having a reproduction speed of 2500 sheets per hour and rated power consumption less than 1.5 KVA so long as conventional contact heat fixing apparatuses are used.

This invention has been accomplished in view of the foregoing and it is an object of this invention to provide a contact heat fixing apparatus for electrophotographic reproduction machines capable of increasing the reproducing speed within the above described conventional rated power consumption.

BRIEF SUMMARY OF THE INVENTION

Briefly, the objects of the present invention are accomplished by the provision of a contact fuser assembly comprising a heated roll structure cooperating with a backup or pressure roll to form a nip therebetween through which copy substrates having toner images thereon move with the toner images contacting the heated roll to thereby soften the toner. In accordance with the invention, a heated roll adapted to periodically contact the heated roll structure is provided for elevating the temperature thereof when its temperature falls off due to a copy substrate passing in contact therewith.

Figure 2:
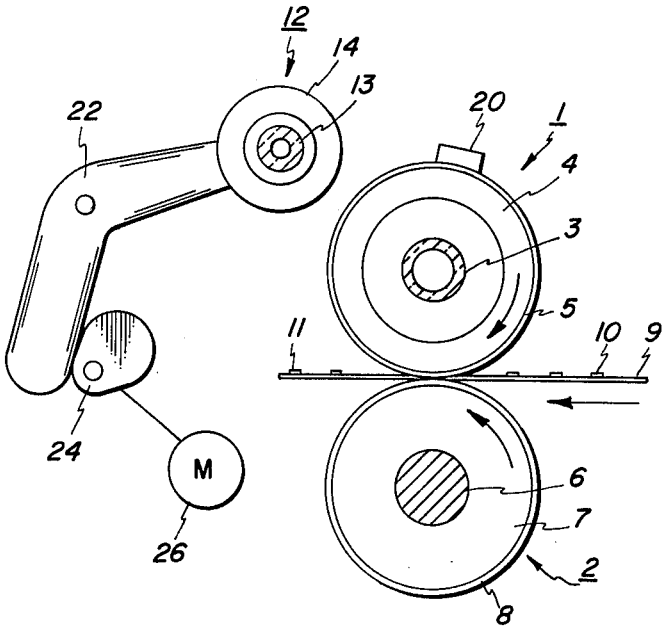
Figure 3:
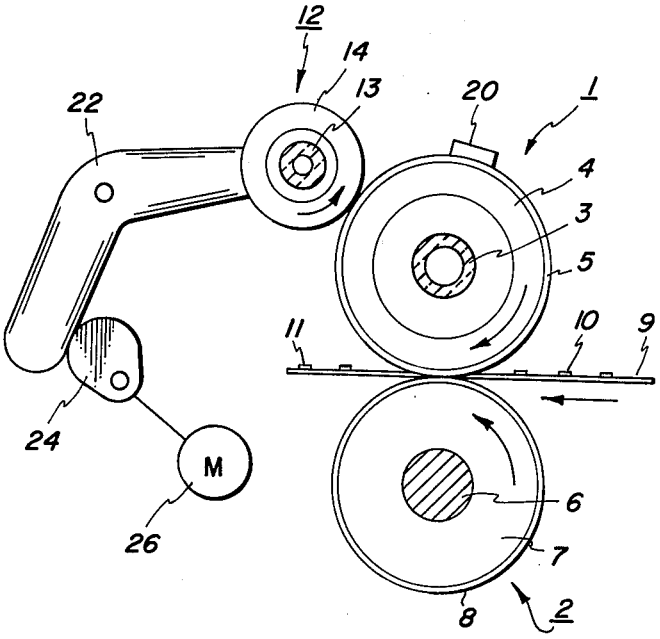

Other objects and advantages of the present invention will become apparent when read in conjunction with the accompanying drawings wherein:

FIG. 1 is a side elevational view of a conventional contact heat fixing apparatus; and FIGS. 2 and 3 are side elevational schematic views of a contact heat fixing apparatus representing the present invention.

This invention is to be described in detail for an embodiment shown in FIG. 2 and the figure succeeding thereafter. In the drawings (FIGS. 2 and 3), reference numerals 1 and 2 denote a heating roll and a pressure roll contacted under an appropriate pressure with each other, wherein one of the rolls, the heating roll 1, comprises a metal core 4 provided over the circumferential surface thereof with a non-adhesion cover 5 and provided at the center thereof with a heating device 3 such as a tubular infrared lamp, and the other roll, the pressure roll 2 comprises wound around its shaft 6 a resilient body 7 such as made of silicone rubber which is applied on the circumferential surface thereof with a cover 8 such as made of fluoroethylenepropylene or the like. In the vicinity of these rolls 1 and 2, are provided an apparatus for coating inhibiter solution for toner off-set prevention, and peeling pawls for the toner support 9 or the like, not shown. The toner support 9 having non-fixed toner images 10 deposited thereon is fed between the heating roll 1 and the pressure roll 2 by means of a conveyor apparatus not shown, whereby the toner images 10 are fused between these rolls 1 and 2 to fix onto the support 9 while the heating device 3 which heats the heating roll 1 is always kept at an optimum temperature with the electric power supplied thereto being controlled by way of detection signals detected by the detection device 20 for temperature control.

Reference numeral 12 represents an auxiliary heating roll supported engageably or disengageably to or from the surface of the heating roll 1 and provided at the center thereof with a heating device 13. The auxiliary heating roll 12 is heated by the heating device 13 and contacted to the heating roll 1 when the temperature of its surface falls below a lower limit for the fixing and heats the same up to a temperature at which the fixing can be effected.

Either one of the heating roll 1 and the pressure roll 2 is made as an aluminum roll and applied over the surface thereof with a cover 6 of KE-12RTV silicone rubber (manufactured by Shin-etsu Chemical Industry) in 200 $\mu$ thickness and incorporated with a heating device 13 of a 700W tubular infrared lamp for heating. In the pressure roll 2, KE-530U silicone rubber (manufactured by Shin-etsu Chemical Industry) in 16 mm thickness is wound around a steel shaft 6 and further, thereover, a heat shrinkable tube cover 8 of fluoroethylenepropylene is applied. In effecting the fixing for the non-fixed images 10, reproduction speed, required temperature of the heating roll 1 and average electric power consumption are as follows:

| | 1000 sheets/h | 1500 sheets/h | 2500 sheets/h |
|---|---|---|---|
| Fixing temperature | 150–175° C | 155–185° C | 165–190° C |

-continued

| | 1000 sheets/h | 1500 sheets/h | 2500 sheets/h |
|---|---|---|---|
| Average electric power consumption | 500W | 700 W | 1200 W |

As can be seen from the above results, the temperature of the heating roll 1 is kept at 155° C by way of a 700 W heating device 3 in a continuous reproduction at a rate of 1500 sheets/hour and with higher speeds, incomplete fixing results. When carrying out a continuous reproduction at 2500 sheets/hour while controlling the surface temperature of the heating roll 1 to 180° C by way of a 700 W heating device 3, the surface temperature decreases below 150° C after reproducing about 80 sheets of copy in spite of the lightening of the heating device 3 and incomplete fixing results thereafter.

Then, in this invention, a continuous reproduction is carried out at a speed of 2500 sheets/hour using an auxiliary roll 12 comprising a copper core 14 and a 700 W tubular infrared lamp as a heating device 13 and controlling the temperature of the roll surface to 200° C, while setting the surface temperature of the heating roll 1 to 180° C. When the temperature of the heating roll 1 falls to 165° C, the auxiliary heating roll 12 is contacted under pressure to the heating roll 1 and rotated (as shown in FIG. 3). The surface temperature of the heating roll 1 is then increased again up to 185° C and, after continuous reproduction for 400 sheets, falls again to 165° C.

According to the foregoing, satisfactory fixing can be effected continuously as far as 400 sheets by the apparatus according to this invention while only about 80 sheets could be fixed in the conventional apparatus.

Although, in the above embodiment, the auxiliary heating roll 12 is contacted under a pressure of 0.5 $Kg/cm^2$, this contact pressure may be varied depending upon the surface temperature of the heating roll 1 since the heat conductivity can be increased with the increase of the pressure. For example, by contacting the auxiliary roll with a pressure of 1.5 $Kg/cm^2$ for the surface temperature of the heating roll 1 at 165° C and 0.2 $Kg/cm^2$ at 185° C, the surface temperature of the heating roll 1 falls below 165° C and incomplete fixing begins to occur after the continuous reproduction for 600 sheets. Thus, reproduction at 2500 sheets/h becomes possible at least for the continuous reproduction of 600 sheets. The operation of contacting and detaching the auxiliary heating roll 12 to and from the heating roll 1 can be performed by a known mechanical means such as a link mechanism or the like in the form of a lever arm 22 pivotally supporting the heating roll 12. The arm is pivoted by means of a cam 24 periodically actuated by motor 26 in response to signals from the detector 20.

In this invention, as detailed above, since the auxiliary heating roll that has been previously heated except the time of reproduction is contacted under pressure to the heating roll when the temperature of the heating roll falls down to heat the same again to a temperature capable of fixing, the reproduction speed can be improved with no increase in the rated electric power consumption of the entire reproduction machine by means of a relatively simple apparatus.

While this invention has been described in conjunction with the preferred embodiment, it will be appreciated that various modifications which do not depart from the spirit and scope of the invention will become apparent and such modifications are intended to be covered in the claims appended hereto.

What is claimed is:

1. Heat and pressure fusing apparatus for fixing toner images to substrate material, said apparatus comprising:

fuser roll structure;

a pressure roll structure cooperating with the fuser roll structure to form a nip through which said substrate material passes with said toner images contacting said fuser roll structure whereby thermal energy is transferred from the latter to the former;

first means for elevating the surface of said fuser roll structure to a first predetermined temperature;

second means for raising the temperature of said surface to said predetermined temperature after said surface falls to a second predetermined temperature below said first predetermined temperature due to said thermal energy transfer;

said second means for raising the temperature of said surface comprising an auxiliary heating roll.

2. Apparatus according to claim 1 including means for periodically effecting engagement of said heating roll with said fuser roll structure, said periodic engagement corresponding to said surface falling to said second predetermined temperature.

3. Apparatus according to claim 2 wherein said auxiliary heating roll comprises an internally heated member comprising a copper core surrounding the heating element.

4. Apparatus according to claim 3 wherein said auxiliary heating roll is adapted to operate at a surface temperature of 200° C and said fuser roll structure is adapted to operate at a surface temperature of 180° C which corresponds to said first predetermined temperature, said auxiliary heating roll operating at such a temperature being adapted to elevate the surface temperature of said fuser roll structure to 180° C from a temperature of about 165° C which corresponds to said second predetermined temperature.

5. Apparatus according to claim 4 wherein said first means for elevating surface temperature of said fuser roll structure comprises a source of thermal energy which is disposed internally thereof.

* * * * *